United States Patent [19]

Shemitz

[11] 4,295,187

[45] Oct. 13, 1981

[54] ASSEMBLABLE CONTAINER

[75] Inventor: Norman S. Shemitz, Milford, Conn.

[73] Assignee: Shem Safe Incorporated, Milford, Conn.

[21] Appl. No.: 125,168

[22] Filed: Feb. 27, 1980

Related U.S. Application Data

[63] Continuation-in-part of Ser. No. 950,592, Oct. 12, 1978, Pat. No. 4,233,656.

[51] Int. Cl.[3] ..... F21V 1/06

[52] U.S. Cl. ..... 362/352; 362/358; 362/360; 362/367; 206/527

[58] Field of Search ..... 362/352, 358, 360, 367; 206/527

[56] References Cited

U.S. PATENT DOCUMENTS 4,117,533 9/1978 Hagelthorpe ..... 362/414 X

*Primary Examiner*—Stephen J. Lechert, Jr.

*Attorney, Agent, or Firm*—Larson and Taylor

[57] ABSTRACT

In a container comprising a plurality of panels held together by a support system having stiff collars at the corners of the panels and connecting members connecting together groups of said collars. At least some of the connecting members are elastic members, as a result of which the support system holds the panels together into a container of a desired polyhedral configuration under the tension of the elastic members. The collars and the connecting members of the support system may be preassembled or kept separate from each other. In either case they can be compacted to a small size for storage, packing or shipping in such state together with a stacked pack of the panels to be used therewith, permitting final assembly of the panels to the support system by the ultimate consumer in a very short time without the need for tools. There results a decrease in space and fragility during storage, shipping and handling, with attendant cost savings.

13 Claims, 9 Drawing Figures

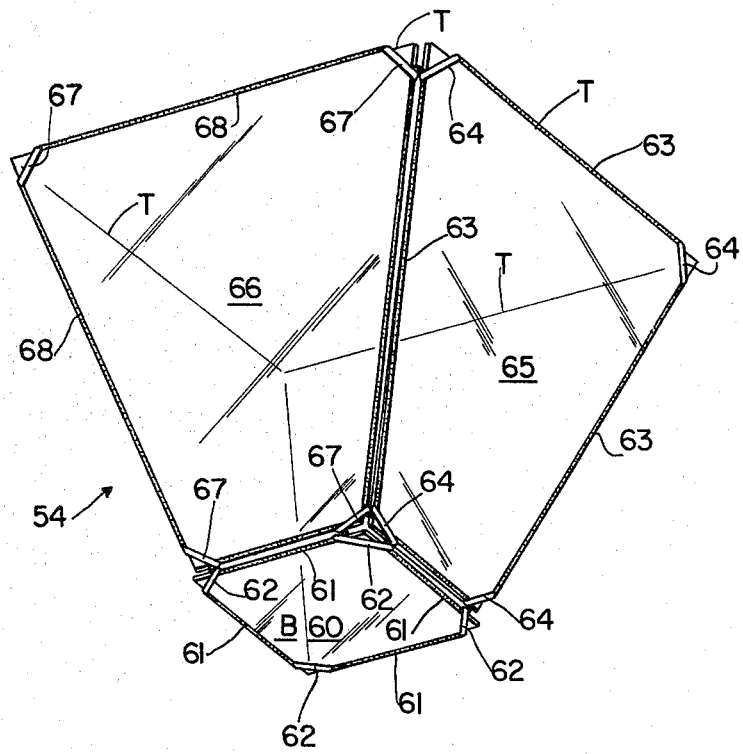
FIG. 7
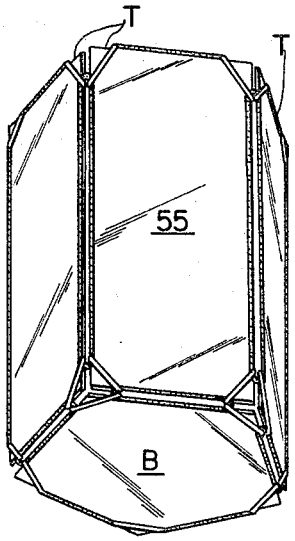
FIG. 8
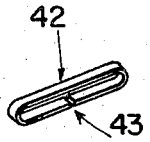
FIG. 9A
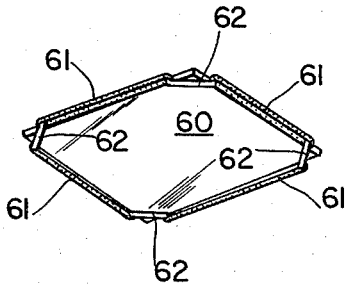
FIG. 9B
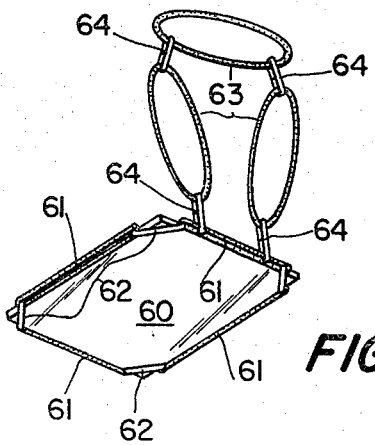
FIG. 9C
FIG. 9D
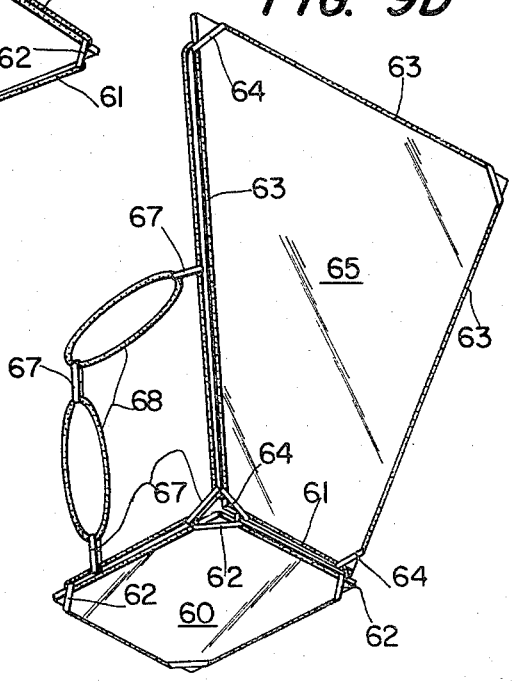

ASSEMBLABLE CONTAINER

RELATED APPLICATION

This is a continuation-in-part of Applicant's prior, copending application, Ser. No. 950,592, filed Oct. 12, 1978, now U.S. Pat. No. 4,233,656.

TECHNICAL FIELD

The present invention relates to containers, and in particular it relates to readily assemblable and disassemblable containers comprising a plurality of separate panels.

BACKGROUND OF THE INVENTION

The present invention relates to containers comprised of a plurality of individual panels connected together by a support system into a predetermined polyhedral configuration. The applicability of such containers is virtually limitless. For example, large durable containers can be connected together to form a simple storage container. Smaller and/or more aesthetically pleasing panels can be connected together to form a decorative bowl such as a candy dish, a vase or the like.

Generally, containers of all kinds are rigidly manufactured into their final configuration in which the containers tend to be relatively bulky, thereby increasing inventory and freight costs associated with storing and shipping such containers. Also containers formed of fragile material such as glass bowls and the like are particularly prone to damage during shipping and handling, even with specially adapted packaging materials.

It is also common to provide certain containers, especially storage containers, in a flat state which can be easily shipped and stored and easily assembled at the point of use. Such containers are usually formed of cardboard or the like and are usually formed in one piece or several pieces capable of being attached together by tabs or the like. In any event, such materials which can be assembled into storage containers from the flat state cannot normally be formed of a highly durable strong material and they do not tend to be aesthetically pleasing. In my previous application Ser. No. 950,592, filed Oct. 12, 1978, of which the present application is a continuation-in-part, there is described the concept of an assemblable lamp shade wherein panels adapted to form a lamp shade, which comprises a portion of a lighting fixture, is made by assembling individual panels together by a support system of the type utilized in the present invention. Prior to my said previous application, there were several patents including U.S. Pat. No. 4,079,245 showing lamp shades formed of individual panels, but wherein the individual panels are held together by rigid connecting elements rather than an elastic tension support system.

SUMMARY OF THE INVENTION

It is the purpose of the present invention to provide a container of the type comprising separate panels, held together by a support system, wherein the above described and other disadvantages of the prior art are overcome.

This purpose of the present invention is achieved by providing a container having a support system made up of stiff collars and elastic members which can be supplied to the ultimate consumer separately from the panels and then easily assembled by the consumer in a manner of minutes, without tools, to provide a container of the desired polyhedral configuration. Consequently, panels made in accordance with the present invention of virtually any size and configuration can be shipped and stored in a highly compacted form with the panels stacked together and the stiff collar members and elastic members provided therewith, the latter taking up an insignificant overall volume. Consequently, the present invention provides the advantages that as compared with containers known heretofore, durable and aesthetically pleasing containers of all sizes can be provided to the ultimate consumer in a compacted form to be assembled by the ultimate consumer, thereby substantially reducing manufacturing costs, shipping costs and breakage.

One application of the present invention is for use as a storage container, i.e. large volume boxes made of fairly durable panels. In accordance with the present invention, such a box can be packaged with the panels stacked and with the various connecting members taking up an insignificant volume and packaged therewith. In such a heavy duty application the panels may be made of any hard material such as wood, hard plastic, composition board or the like. Although it is normally contemplated that the elastic members would constitute endless loops, in a heavy duty application of the present invention, these elastic members may comprise "shock cords", i.e. the well known heavy duty cords having hooks at both ends as now commonly used for securing objects onto vehicles such as onto the tops of station wagons.

In accordance with another application of the present invention, more delicate containers such as flower vases, candy and cigarette dishes and the like can be formed by assembling together smaller aesthetically pleasing panels such as glass panels into various configurations.

In accordance with a preferred embodiment of the present invention, for any of its various applications, the support system for the container comprises rigid collars placed onto the corners of the panels with elastic members interconnecting the collars together such that groups of adjacent collars on juxtaposed panels are connected together at their proximate ends by said elastic members while at its other end the elastic member connects together another collar or another group of adjacent collars, wherein the elastic member is stretched between the two groups of collars, thereby releasably holding all of the collars in place against their respective panels. With such a system of collars and elastic members located throughout the spaces between adjacent panels, all of the panels of the containers are held together under tension to provide a container rigidly formed into its desired polyhedral configuration.

The objects and advantages of the present invention will become apparent from the detailed description which follows of preferred embodiments of the present invention.

BRIEF DESCRIPTION OF THE DRAWINGS

The present invention will now be described with reference to preferred embodiments which are to be read together with the accompanying drawings wherein.

Each of FIGS. 3 through 8 is a perspective view looking from below of a different container made in accordance with the present invention.

FIG. 9A is an enlarged perspective view of a collar used in the present invention.

FIGS. 9B through 9D are perspective views, taken from below, showing the stages in forming a container of the type shown in FIG. 7.

DETAILED DESCRIPTION OF THE PREFERRED EMBODIMENTS

Referring now to the figures, like elements are represented by like numerals throughout the several views.

Figure 1:
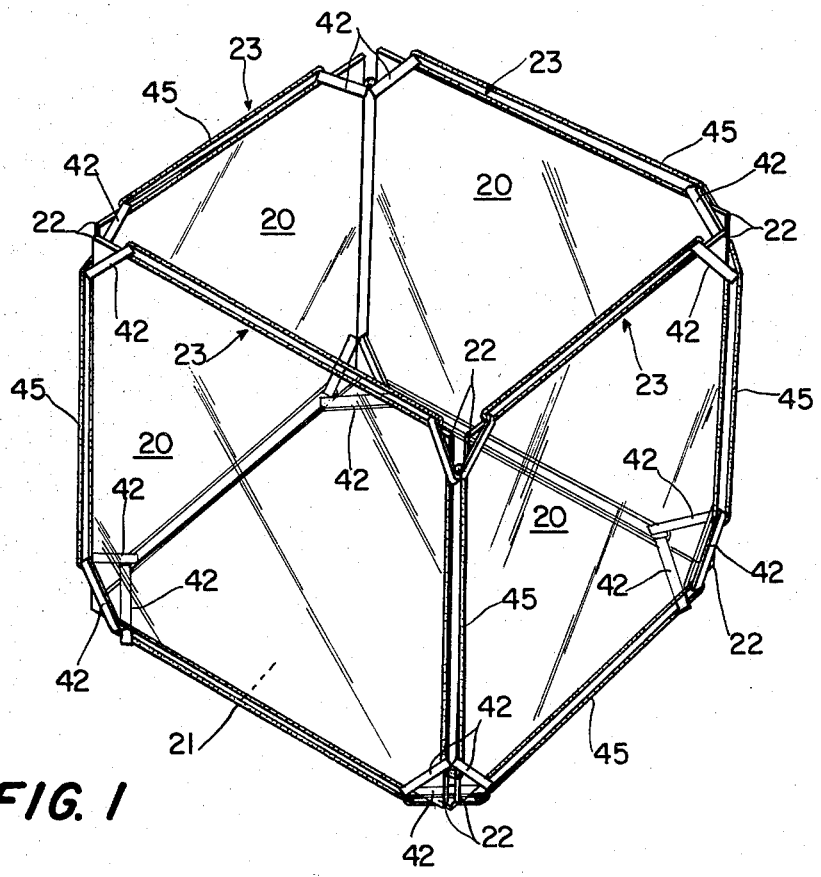
FIG. 1 is a perspective view looking from above of a container of a generally cubicle shape.
Figure 2:
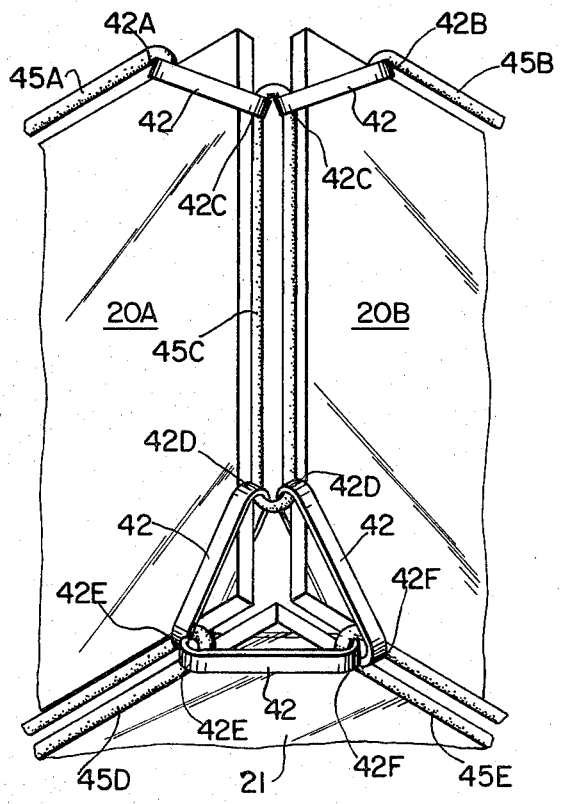
FIG. 2 is a perspective view looking from below onto a portion of the container of FIG. 1.

Referring to FIGS. 1 and 2 there is shown a container 10 constructed in accordance with the present invention. For purposes of illustration, the container 10 is shown with transparent panels. In this form it could be made relatively small so as to constitute a candy dish or cigarette dish, or slightly larger so as to constitute a planter or the like. For these uses it would of course also be made of an opaque, although preferably asthetically pleasing material. Alternatively, the container 10 could be made of a much larger size, for example with panels of two to four feet on each side so as to constitute a large storage container. If desired, such large containers could also be made of a plastic, transparent material, in which case the storage container would have an appearance precisely like the container 10 of FIGS. 1 and 2. Alternatively, for purposes of economics, a large storage container would normally be formed of opaque, durable panels.

The container 10 of FIGS. 1 and 2 basically comprises a plurality of side panels 20 having corners 22 and upper edges 23 which form the upper opening of the container. The panels 20 are connected to a bottom panel 21.

The support system for rigidly securing the panels into the desired polyhedral configuration comprises a plurality of collar members 42, one of which engages each corner 22 of the panels 20 and the corresponding corners of the bottom panel 21. A single collar 42 is shown in FIG. 9A. It is stiff, preferably metallic. Ideally these collars are formed by taking an elongated strip of ribbon-like material and bending it into the configuration shown in FIG. 9A with the ends thereof meeting at 43, whereat the ends are preferably close together but are not connected together. In addition to the collars, the support system comprises elastic members 45, each of which engages one or more collars. The elastic members are preferably formed as endless loops, in which case they are engaged within their respective collars by momentarily pushing apart the two ends of the collars which meet at point 43. In the finished container, all of the collars are engaged by selected ones of the elastic members so that in the final polyhedral container, the elastic members, acting through the collars, pull the panels together into the desired polyhedral configuration with the necessary degree of rigidity.

For purposes of clarity, one of the edges of the container 10 is shown in an enlarged view in FIG. 2. The term "groups of collars" refers to a grouping of ends of collars at a given point whereat all members of the group are engaged by the same end of the same elastic member. For example, at the top of panel 20A the end 42A is the only member of the group engaged by cord 45A. Similarly, along the top of panel 20B the collar end 42B is the only element engaged by the elastic member 45B. Between the panels 20A and 20B toward the upper end of such edges, the two ends 42C of their respective collars 42 form a group of collars engaging the upper end of elastic member 45C. In similar fashion, the two collar ends 42D form a group which engage the lower end of elastic member 45C; the two collar ends 42E comprise a group of collars engaging the elastic member 45D and the two ends 42F constitute a group of collars engaging the elastic member 45E.

It will be understood that the container is constructed in an identical manner at the other three corners of the container.

Figure 3:
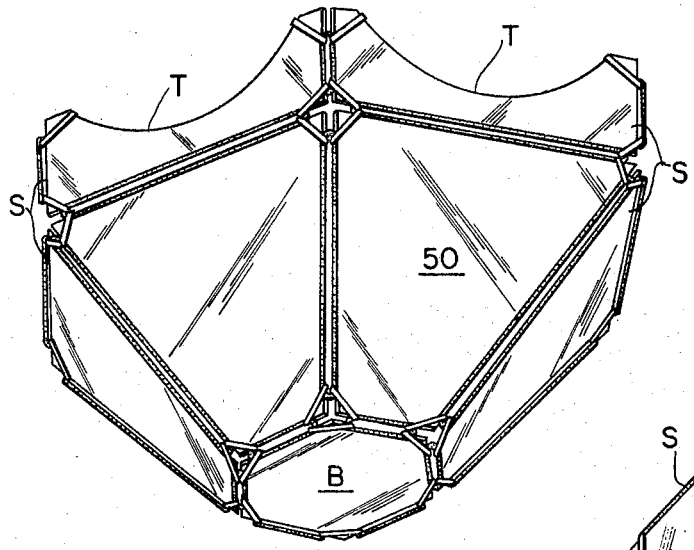
Figure 4:
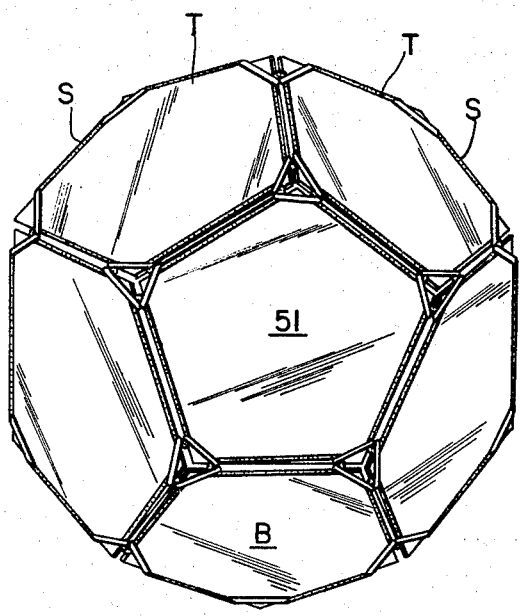
Figure 5:
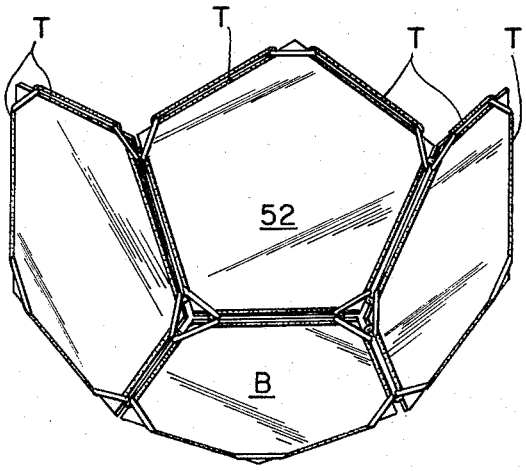
Figure 6:
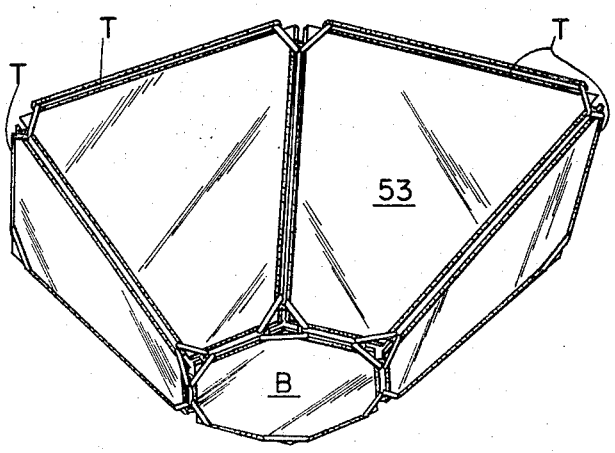

It will be apparent that the basic features of the present invention can be utilized to form a virtually infinite number of different sizes and shaped of containers. Six different containers 50 through 55 are illustrated in FIGS. 3 through 8, respectively. In each of these perspective views taken from below, the bottom panel has been designated by the letter B while top edges have been designated by the letter T. In FIGS. 3 and 4 wherein confusion could arise as to whether or not certain edges are top edges, the letter S has been used to indicate certain side edges, clarifying that they are not top edges. It will be understood that in all of the shapes of FIGS. 3 through 8 the sides non-visible are formed as continuations of the sides which are visible.

Generally, all of the collars 42 on a given panel are connected by elastic members 45 to collars of other groups. However, it is also possible that especially at the upper edge of the container the panel could be formed in such a way as to limit movement of the collar, thereby precluding the need for a second elastic member on that collar. An example of such an arrangement is shown in FIG. 3 whereat the collars at the upper edges of the container engaged curved portions along the top of the container, thereby eliminating the need for further elastic members along the top of that container.

As explained in my previous application, the support system could be completely preformed, i.e. all of the loops and collars could be connected together in advance of assembling them onto any panels.

However, it has been found preferable for purposes of economics and simplicity to simply provide the person who will assemble the container with the correct number of collars and elastic members, coupled with clear instructions for assembling the collars and loops together as the container assembly progresses.

Such a typical step-by-step procedure is illustrated in FIGS. 9B through 9D for assembling a container as shown in FIG. 7. Referring to FIG. 9B, the assembler first assembles four cords 61 onto collars 62 and places this assemblage around the edges of the bottom panel 60 with the collars 62 engaged onto the corners of panel 60. A pair of collars 64 are then snapped onto one of the lower elastic members 61 and to these there are attached in sequence a pair of further elastic members 63, a pair of further collars 64 and an upper elastic member 63. It will be understood that not all elastic members are of the same size. For example, the support system elements provided for this assemblage would include smaller elastic members 61 and much larger elastic members 63.

A first side panel 65 is then placed into the assemblage of elements 63 and 64 as shown in FIG. 9D. The assembler then attaches a pair of additional collars 67 and elastic members 68 onto the existing elastic members 61 and 63 as shown on the left side of FIG. 9D. The panels 66 is then placed into the assemblage of elements 67 and 68, bounded on the right and below, of course, by the elastic member 63 and 61, respectively. The assembler then continues around the container in this fashion until the container 54 of FIG. 7 is formed.

Although the invention has been described in considerable detail with respect to preferred embodiments thereof, it will be apparent the the invention is capable of numerous modifications and variations apparent to those skilled in the art without departing from the the spirit and scope of the invention.

I claim:

1. A support system for a container having a plurality of panels forming at least the sides and bottom of the container and connected together by the support system in a predetermined polyhedral configuration, each of the panels defining a plurality of corners; comprising, a plurality of collars, each collar being adapted to extend around a corresponding one of the panel corners, elastic connecting members connecting at least some of the collars together such that groups of opposing, adjacent collars on juxtaposed panels are connected together at their proximate ends by a said elastic member, and at least some of the said groups of collars are connected to other groups of collars which are spaced from the first said group by tensioned elastic members stretched between the said groups of collars, such that all of the collars are capable of being releasably held in place on their respective panels, to releasably hold all of the panels under the tension of the elastic members in the predetermined polyhedral configuration.

2. The support system of claim 1, wherein said collars are each in the form of a flattened member formed as a closed loop of flattened metallic wire.

3. The support system of claim 1, wherein said elastic members are formed as continuous closed loops.

4. The support system of claim 1, in combination with a pack of panels adapted to cooperate with the support system to form the lamp shade of the said predetermined polyhedral configuration.

5. A method of assembling a container from the combination of claim 4, comprising taking a first panel, placing thereon all of the collars of the support system adapted for that panel, including stretching the respective elastic members around the edges thereof, taking an adjacent panel and placing thereon the collars which are opposed adjacent collars to those of the first panel, placing the remaining collars on that second panel, including stretching the respective elastic members around the edges thereof and continuing to take adjacent panels and attach its respective collars thereto.

6. The method of claim 5, wherein said first panel is the bottom panel of the container.

7. A container comprising a plurality of panels forming at least the bottom and sides of the container and connected together by a support system in a predetermined polyhedral configuration, each of the panels defining a plurality of corners, and the support system comprising a plurality of collars, each collar being adapted to extend around a corresponding one of the panel corners, elastic connecting members connecting at least some of the collars together such that groups of opposing adjacent collars on juxtaposed panels are connected together at their proximate ends by a said elastic member and at least some of the said groups of collars are connected to other groups of collars spaced from the first said group by tensioned elastic members stretched between the said groups of collars such that all of the collars are releaseably held in place on their respective panels and all of the panels are releaseably held under the tension of the elastic members in the predetermined polyhedral configuration.

8. The container of claim 7, wherein at least some of the vertically extending panel edges facing a adjacent panel edge include thereat an elastic member.

9. The container of claim 7, wherein said collars are each in the form of a flattened annulus formed as a closed loop of flattened metallic wire.

10. The container of claim 7, wherein said elastic members are formed as continuous closed loops.

11. The lamp shade of claim 7, wherein all groups of collars at a first intersection of panel corners are connected to at least one other group of collars at another intersection of panel corners by a said elastic member.

12. The invention of claim 1 or claim 7, said collars being a stiff material in the form of an elongated flat member formed as a closed loop with the ends of the elongated member close together to essentially close the loop but not connected together.

13. The invention of claim 12, said elastic members being closed loops insertable into the collars between said close ends.

* * * * *